US009373457B2

(12) United States Patent
Roelandt et al.

(10) Patent No.: US 9,373,457 B2
(45) Date of Patent: Jun. 21, 2016

(54) CIRCUIT BREAKER INDICATING CAM HAVING A PROFILE WHICH REDUCES TRANSMISSION OF MECHANICAL SHOCKS TO THE AUXILIARY RELEASE

(71) Applicant: Schneider Electric Industries SAS, Rueil Malmaison (FR)

(72) Inventors: Hubert Roelandt, Vif (FR); Frank Emeyriat, Grenoble (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 85 days.

(21) Appl. No.: 14/364,547

(22) PCT Filed: Jan. 7, 2013

(86) PCT No.: PCT/FR2013/000007
§ 371 (c)(1),
(2) Date: Jun. 11, 2014

(87) PCT Pub. No.: WO2013/102726
PCT Pub. Date: Jul. 11, 2013

(65) Prior Publication Data

US 2014/0299455 A1 Oct. 9, 2014

(30) Foreign Application Priority Data

Jan. 6, 2012 (FR) ..... 12 00058

(51) Int. Cl.
*H01H 5/00* (2006.01)
*H01H 5/06* (2006.01)
(Continued)

(52) U.S. Cl.
CPC ..... *H01H 5/06* (2013.01); *H01H 3/3015* (2013.01); *H01H 71/04* (2013.01)

(58) Field of Classification Search
CPC ..... H01H 71/04; H01H 2071/046; H01H 2003/3057; H01H 3/3015; H01H 3/42
USPC ..... 200/400, 401, 308, 325; 335/17, 76
See application file for complete search history.

(56) References Cited

U.S. PATENT DOCUMENTS 4,220,936 A 9/1980 Powell
6,144,002 A 11/2000 Coudert et al.
(Continued)

FOREIGN PATENT DOCUMENTS

EP 0 997 919 5/2000
EP 2 110 835 10/2009
WO 2009 100681 8/2009

OTHER PUBLICATIONS

French Search Report Issued Sep. 11, 20132 in Application No. FF 1200058 Filed Jan. 6, 2012.
(Continued)

*Primary Examiner* — Vanessa Girardi
(74) *Attorney, Agent, or Firm* — Oblon, McClelland, Maier & Neustadt, L.L.P.

(57) ABSTRACT

An electric power circuit breaker with an energy storage device and an indicating device including an indicator lever with an indicator and an indicating cam of loaded and unloaded states of the loading mechanism. The indicating cam is mounted on the loading shaft in proximity to the loading cam, and includes a notch for receipt of the indicator lever when the mechanism is in the loaded state. The indicating cam includes a single ramp for progressively bringing the indicator lever into position up to the notch to guarantee latching of the opening latch maintained in a tripped position by the auxiliary release.

5 Claims, 13 Drawing Sheets

(51) Int. Cl.
*H01H 3/30* (2006.01)
*H01H 71/04* (2006.01)

(56) References Cited

U.S. PATENT DOCUMENTS 6,437,269 B1 * 8/2002 Rakus ..... H01H 3/3015 200/400
2009/0256660 A1 10/2009 Babu et al.

OTHER PUBLICATIONS

International Search Report Issued Jun. 6, 2013 in PCT/FR13/000007 Filed Jan. 7, 2013.

* cited by examiner

*Fig. 1* OPEN - UNLOADED

*Fig. 2* OPEN - LOADED

*Fig. 3* OPEN - UNLOADED

*Fig. 4* CLOSED - UNLOADED

CIRCUIT BREAKER INDICATING CAM HAVING A PROFILE WHICH REDUCES TRANSMISSION OF MECHANICAL SHOCKS TO THE AUXILIARY RELEASE

BACKGROUND OF THE INVENTION

The invention relates to a multipole electric circuit breaker having a pair of separable contacts per pole and an operating mechanism comprising:

- a toggle device associated with a switching bar and with a trip latch,
- an opening spring automatically loaded when a closing operation of the toggle device takes place,
- an energy storage device with a closing spring operated by a loading device composed of a loading cam keyed onto a loading shaft and a drive part acting as transmission means between the energy storage device and the toggle device to perform driving of the switching bar and of the movable contacts to the closed position when relaxation of the closing spring takes place,
- a closing ratchet and latch designed to lock the energy storage device in a loaded state,
- an opening ratchet and latch designed to collaborate with the trip latch and with an auxiliary release,
- and an indicating device comprising an indicator lever with an indicator collaborating with an indicating cam to indicate a loaded, unloaded and ready-to-close state of the mechanism, said indicating cam being fitted on the loading shaft close to the loading cam, and being provided with a notch for receiving the indicator lever when the mechanism is in the loaded state.

STATE OF THE ART

A known circuit breaker with an opening-closing-opening (OCO) mechanism of the kind mentioned is described in the document EP 997919 filed by the applicant. The mechanism comprises a toggle device associated with a switching bar and an opening spring, an energy storage device with a closing spring, means for indicating the state of the circuit breaker, and means for controlling opening and closing of the poles. The energy storage device is loaded by means of a loading cam associated with an indicating cam, said cams both being keyed onto a common loading shaft.

In both the open-loaded and open-unloaded states of the mechanism, an opening latch occupies:

- either a rest position being subjected to a single bias spring,
- or a maintained tripped position being permanently biased by an auxiliary trip release detecting an electric fault on the power system, or by the opening push-button which is latched.

When the loading device is not loaded, a pin of the drive part interferes with the curved peripheral edge of the indicating cam.

An indicator of the "ready to close" state enables re-closing of the circuit breaker provided that:

- the loading cam is in the loaded position,
- the bar is in the open position,
- and the opening latch is in the rest position.

This indicator is arranged on an indicator lever with multiple arm, and also enables two other states to be indicated, one corresponding to the non-loaded position and the other corresponding to an energy storage device that is loaded but is not in its "ready to close" state.

The indicator lever collaborates with a mechanical link associated with the closing ratchet to transmit a manual closing order to the energy storage device if and only if the indicator is in the "ready to close" state. When the closing order is given, the energy of the storage device is released resulting in abrupt relaxation of the closing spring and reclosing of the contacts of all the poles.

To prevent an over-rotation movement of the loading shaft and of the loading cam at the moment this reclosing phase takes place, it has already been proposed to modify the profile of the loading cam. The dead point of the loading cam has been advanced by offsetting the boss of the cam by a predefined angle, for example 10°, so as to reduce the slope between the dead point and the end of the loading cam.

This angular offset of the dead point causes an advanced rocking of the mechanism, but nevertheless increases the peripheral distance between the boss at the dead point and the end of the loading cam. The over-rotation effect is prevented, but the speed of rotation of the loading shaft is greater at certain points. The indicating cam being indexed on the loading cam, it has been observed that, at the end of loading of the energy storage device, rocking of the indicator lever in the notch of the indicating cam was liable to cause a mechanical shock on a trip lever of the auxiliary trip release(s).

At the end of manual reloading of the energy storage device, the indicator lever of the indicator in fact strikes the opening latch with propagation of the impact on the trip lever connected with the rod of the auxiliary release.

The auxiliary release is normally used to fulfil two functions:

- automatic tripping of the opening latch and ratchet to cause separation of the contacts of the poles;
- maintaining of the opening order when an electric fault occurs, ensuring mechanical latching which prevents any closing operation of the poles. Latching is performed by maintaining the rod of the auxiliary release in the salient position so long as the fault persists. The operator can on the other hand manually reset the energy storage device, but cannot close the contacts without having acknowledged the fault.

Transmission of a mechanical impact on the auxiliary trip lever does not however enable this second latching function by the auxiliary release to be guaranteed in complete safety. If the impact is greater than the resistance force (about 1.3 N) of the auxiliary release, its rod drops to a withdrawn position and causes initialisation of said trip release. The operator can then close the contacts of the poles by means of the closing push-button, whereas the fault has not been acknowledged. If this fault persists, the apparatus does not open, as the auxiliary release requires receipt of a new tripping order.

To remedy this problem of non-guarantee of latching by the auxiliary release, solutions could consist in increasing the resistance force of the auxiliary release MX, and/or in absorbing the mechanical shocks by means of rubber shock absorbers. But these solutions are complicated and difficult to implement.

OBJECT OF THE INVENTION

The object of the invention consists in providing a multipole power circuit breaker equipped with an improved loading mechanism preventing both any over-rotation movement of the loading shaft and also any closing of the poles in case of a non-acknowledged electric fault.

The circuit breaker according to the invention is characterized in that the indicating cam is provided with a single ramp for progressively moving the indicator lever into position up to the notch guaranteeing latching of the opening latch in the tripped position by the auxiliary release.

At the end of manual loading of the energy storage device, the height of fall of the indicator lever is thus reduced when the latter is inserted in the notch so as not to affect the withstand of the release MX when the latter receives an opening order following a non-acknowledged fault. Any attempt to perform reclosing of the contacts is excluded so long as the fault has not been acknowledged.

According to one feature of the invention, the loading cam and the indicating cam are mechanically secured to one another by spacers and are mounted axially on the loading shaft, which is advantageously grooved in the axial direction. Each cam comprises a central opening of circular shape provided with a radial index so as to constitute a radial reference plane passing through said aligned indexes. The notch of the indicating cam is U-shaped, delineated by a straight first flank and an inclined second flank, the straight first flank being offset from the reference plane by an angle $\alpha$ comprised between 10° and 20°, and the top end of the second flank joining the terminal part of the progressive ramp being separated from the reference plane by an angle $\beta$ comprised between 20° and 40°.

Preferably, the loading cam of the loading device presents a rocking dead point offset from the end of the cam by an angle $\delta$ comprised between 30° and 45° so as to prevent any over-rotation movement of the loading shaft and of the loading cam at the moment the reclosing phase of the poles takes place.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
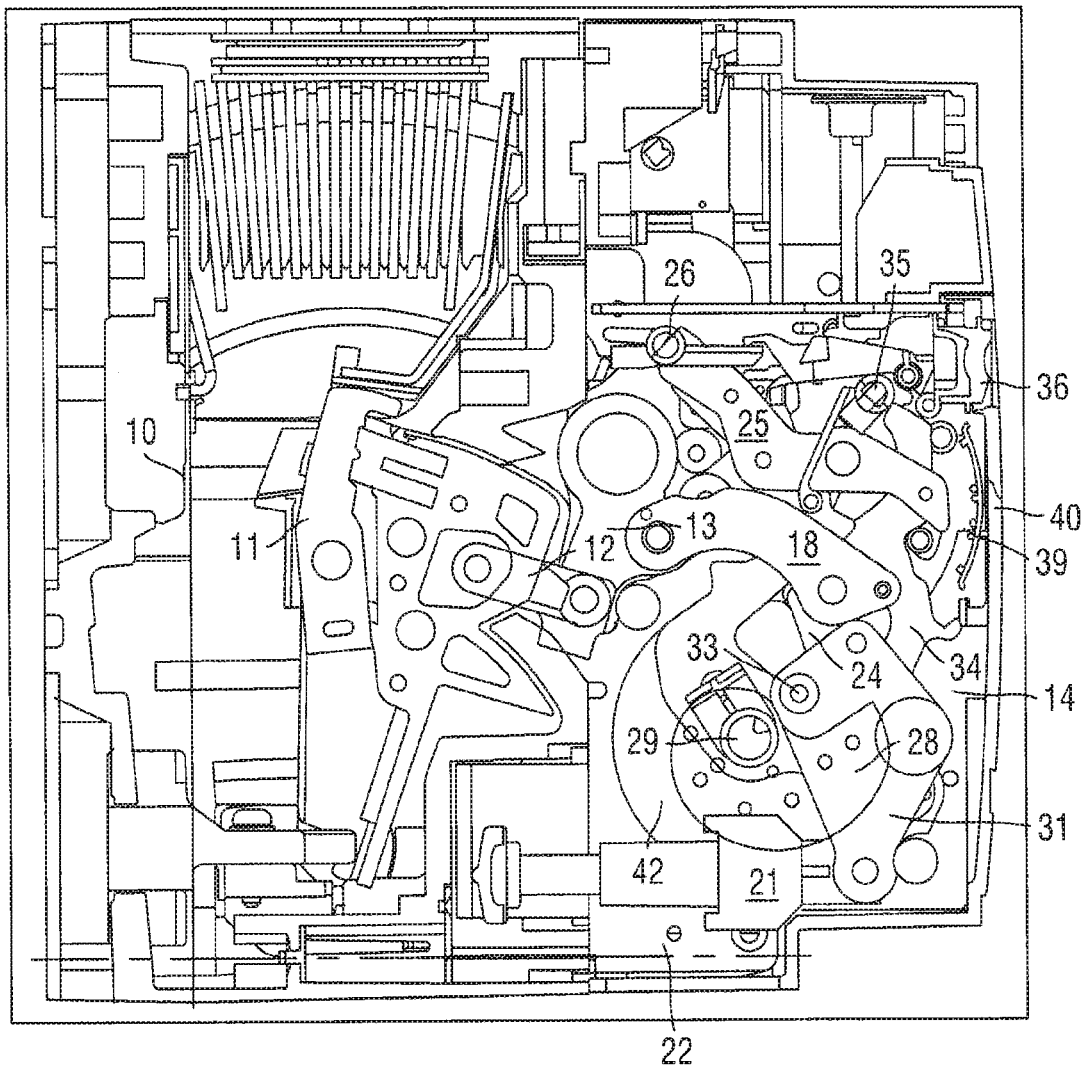
FIG. 1 is a schematic cross-sectional view of a pole of the circuit breaker and of its operating mechanism, the circuit breaker being shown in the open unloaded state.
Figure 2:
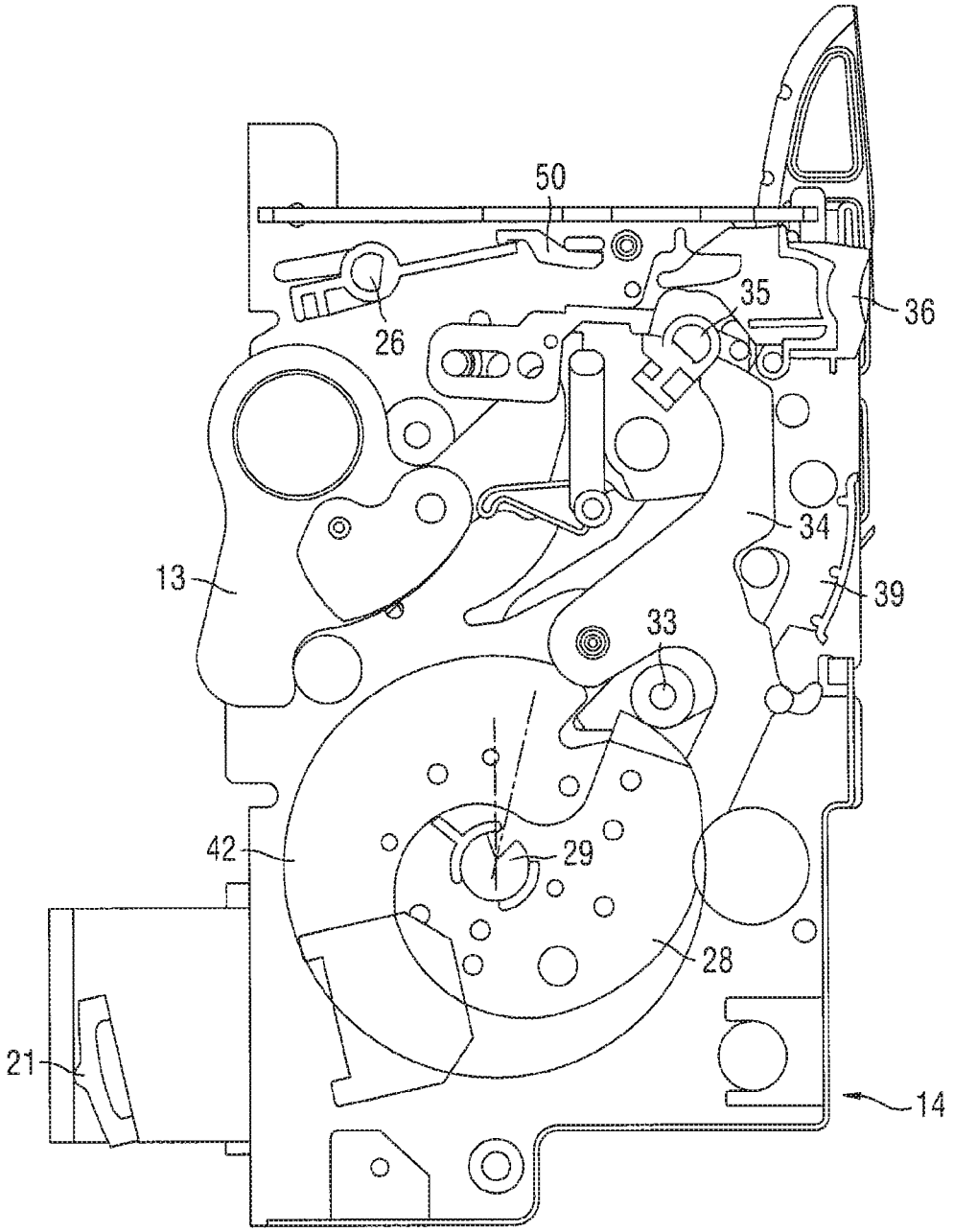
FIGS. 2 to 4 show views of the mechanism respectively in the open-loaded, open-unloaded and closed position.
Figure 3:
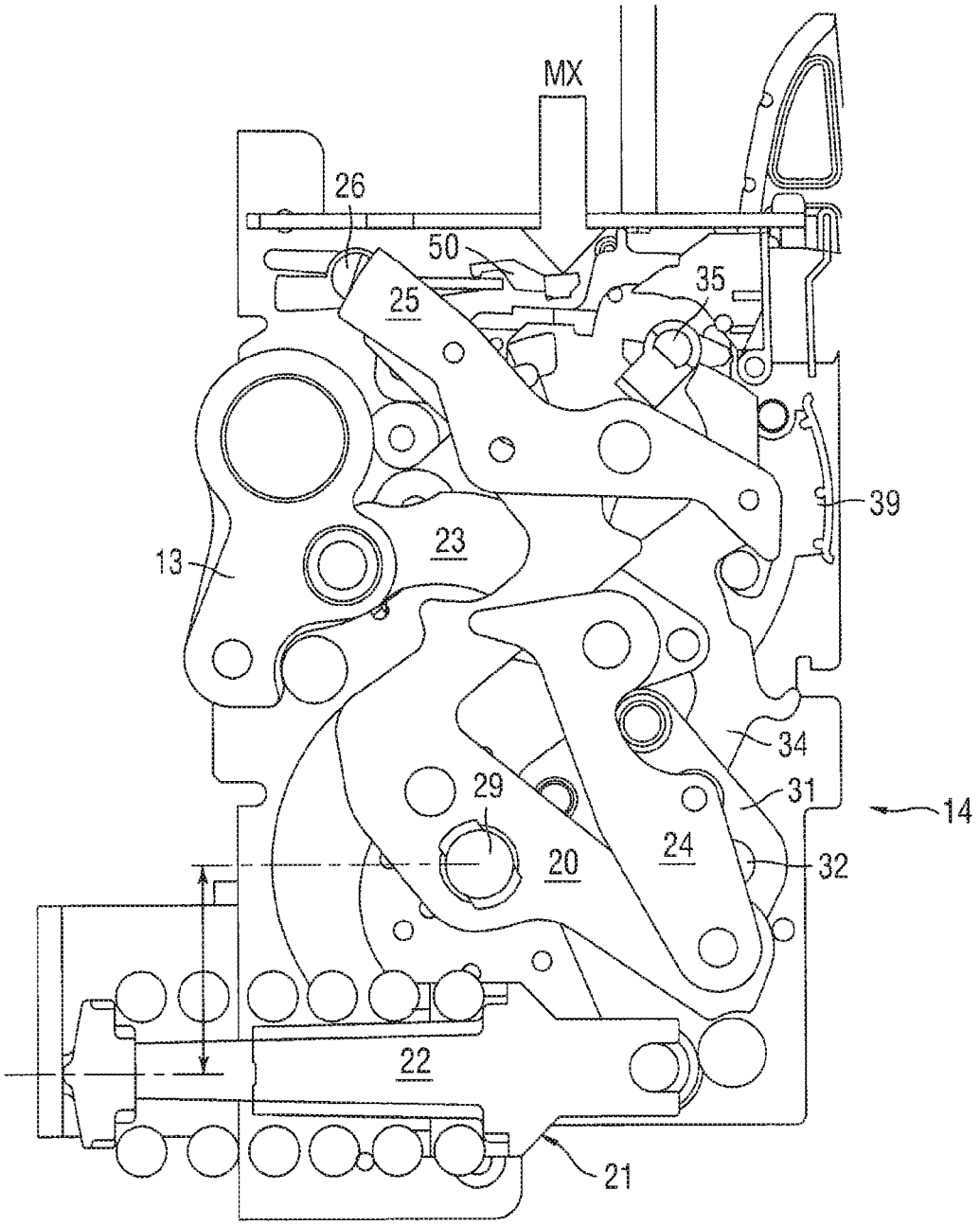
Figure 4:
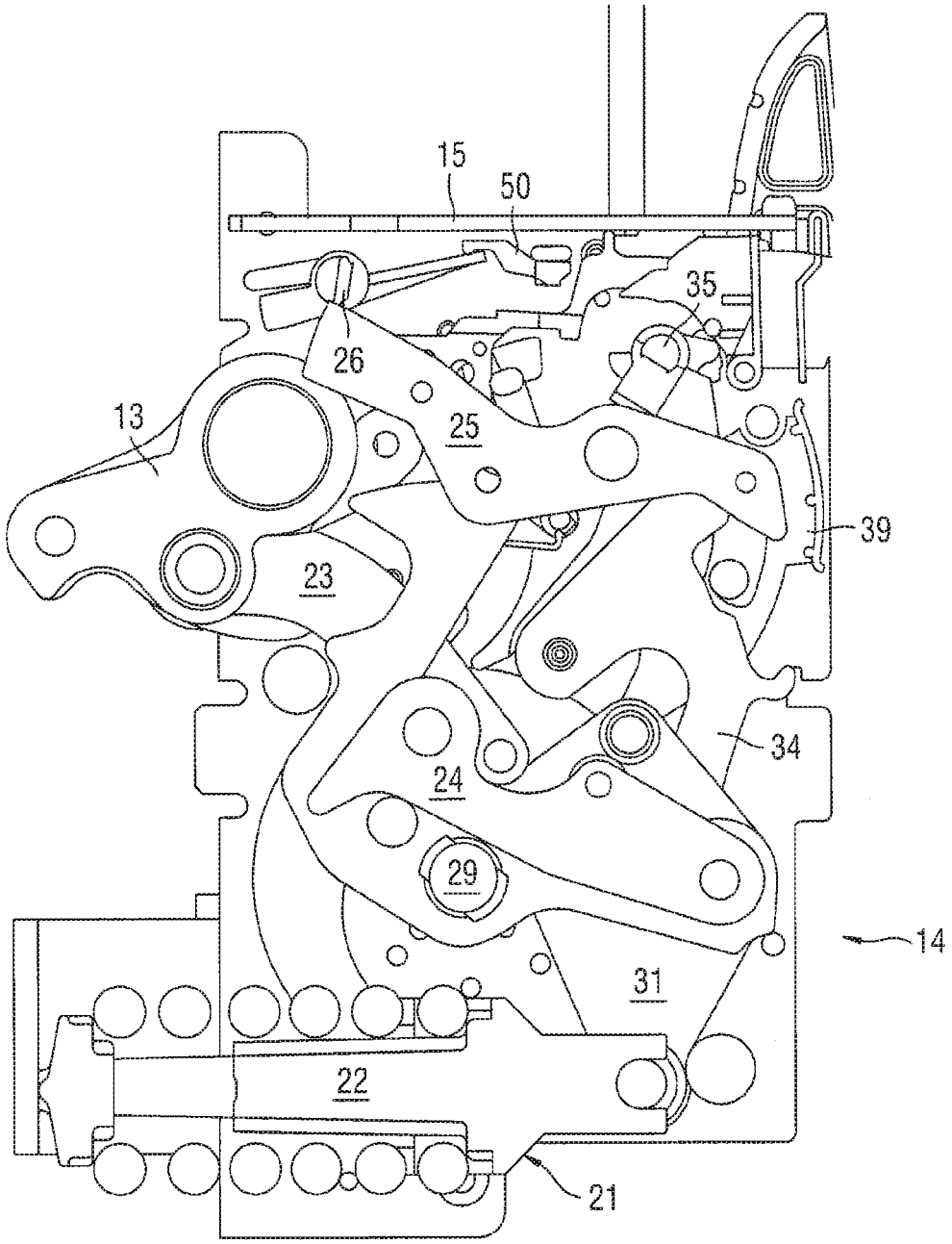
Figure 5:
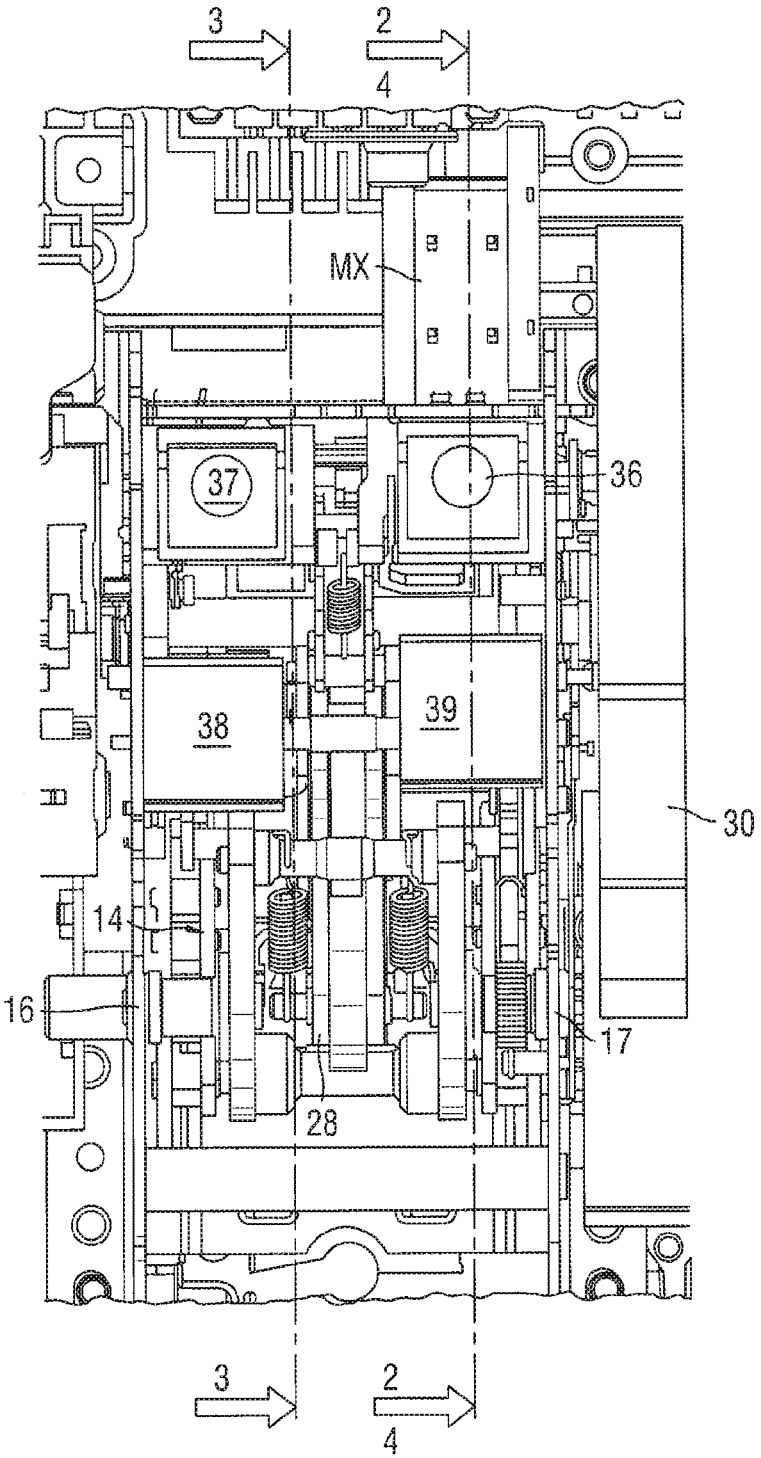
FIG. 5 represents a front view of the mechanism equipped with the closing push-button, the opening push-button, the first indicator for indicating the open or closed state of the contacts, the second indicator for indicating the loaded-unloaded state of the energy storage device, and the auxiliary release.
Figure 6:
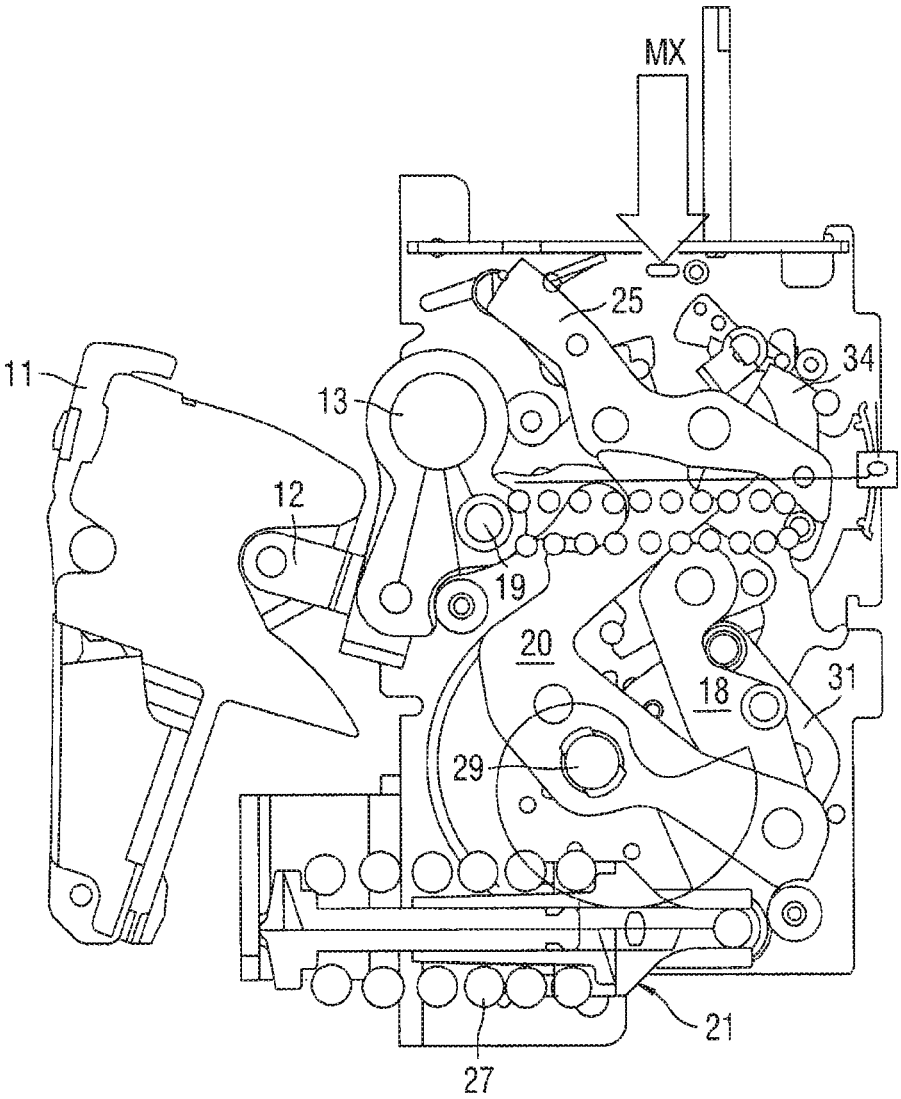
FIG. 6 is a schematic view of the mechanism from the loading cam side.

In FIGS. 1 to 8, a low-voltage multipole electric circuit breaker comprises a pair of separable contacts 10, 11 in each pole, the movable contact element 11 being connected by a crank 12 to a common switching bar 13. The latter is formed by an insulating shaft driving the movable contact elements 11 of all the poles in limited rotation between a closed position and an open position, and vice versa.

The circuit breaker is actuated by an operating mechanism 14, which is supported by a frame 15 with two parallel flange-plates 16, 17. Operating mechanism 14 comprises a toggle device 18 associated with an opening spring 19, a swivelling trip latch 20, and a mechanical energy storage device 21 controlled by a loading device 22. Mechanism 14 is designed to perform successive opening-closing-opening OCO movements of the poles, without requiring a new storage of energy in energy storage device 21.

Toggle device 18 comprises a first rod 23 articulated on a second rod 24 by a pivot-pin, first rod 23 being coupled to switching bar 13, and second rod 24 being articulated on trip latch 20. Opening spring 19 is secured to pivot-pin of the two rods 23, 24 to solicit folding of toggle device 18 and opening of contacts 10, 11 on automatic tripping or a manual opening command. This opening spring 19, constituted for example by a traction spring, is automatically loaded when a closing operation of the contacts takes place. Toggle device 18 can thus occupy either a folded position corresponding to the open position of switching bar 13, or an extended position corresponding to the closed position of said bar. Trip latch 20 collaborates with an opening ratchet 25 operated by an opening latch 26, which can occupy a latched position or an unlatched position.

Energy storage device 21 houses at least one telescopic support for compression of closing spring 27, so as to be loaded independently from the position of contacts 10, 11. Loading device 22 is composed of a loading cam 28 keyed onto a main loading shaft 29 which can be actuated by a manual resetting handle 30 in connection with a ratchet and ratchet wheel system. Resetting can also be performed electrically by means of a geared motor (not shown) keyed onto loading shaft 29. A swivelling drive part 31 acts as transmission means between energy storage device 21 and second rod 24 of toggle device 18 to perform driving of switching bar 13 and of contacts 10, 11 to the closed position when controlled relaxation of closing spring 27 takes place. Drive part 31 is mounted swivelling on a pivot-pin 32, and is provided with a roller 33 angularly offset with respect to pivot-pin 32 and collaborating with the peripheral edge of loading cam 28.

Operating mechanism 14 further comprises:

- a closing ratchet 34 controlled by a closing latch 35. In the loaded compressed position of closing spring 27, loading cam 28 is blocked in rotation by closing ratchet 34, itself latched in position by its latch 35.
- a closing push-button 36,
- an opening push-button 37,
- a first indicator 38 indicating the open or closed state of contacts 10, 11,
- a second indicator 39 indicating the loaded or unloaded state of energy storage device 21. Second indicator 39 is visible through a window 40 situated on the front panel of the circuit breaker, and is arranged on a swivelling indicator lever 41 provided with several arms;

an auxiliary release MX for remote tripping control, and an indicating cam 42 for indicating the state of the circuit breaker, which is mounted on loading shaft 29 in proximity to loading cam 28, and comprising a notch 43.

Indicator lever 41 is equipped with a first arm 44 the end of which is designed to engage in notch 43 of indicating cam 42 when loading shaft 29 reaches the loaded position of energy storage device 21. Indicator lever 41 is provided with a second arm designed to interfere with switching bar 13, and with a third arm 46 collaborating with opening latch 26.

OCO operating mechanism 14 of the circuit breaker can occupy different operating states, i.e. a closed state, an open unloaded state, and an open loaded state. Three conditions are compulsory to be able to reclose contacts 10, 11 of poles:

energy storage device 21 has to be in the loaded position with closing spring 27 compressed;

the switching bar has to be in the open position;

and opening latch 26 has to occupy an inactive rest position.

The combination of these three parameters defines a "ready to close" state which is indicated on the front panel by a mechanical and/or optic indicator. A mechanical connection between closing push-button 36 and closing latch 35 enables a closing order to be transmitted in this "ready to close" state by means of closing push-button 36 to release loading cam 28 allowing relaxation of spring 27 and driving of switching bar 13 and contacts 10, 11 to the closed position.

Figure 7:
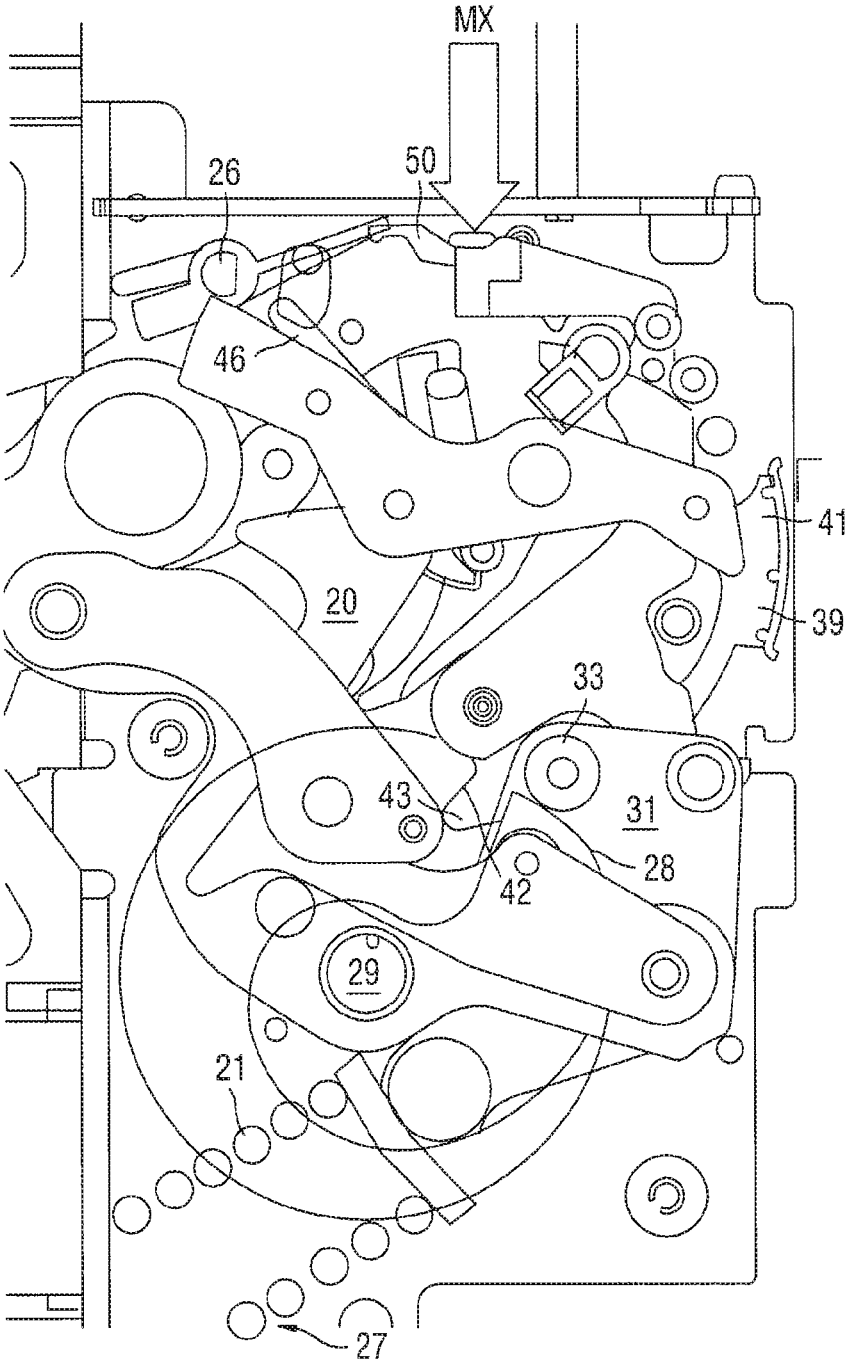
FIG. 7 is a schematic view of the mechanism from the indicating cam side.
Figure 8:
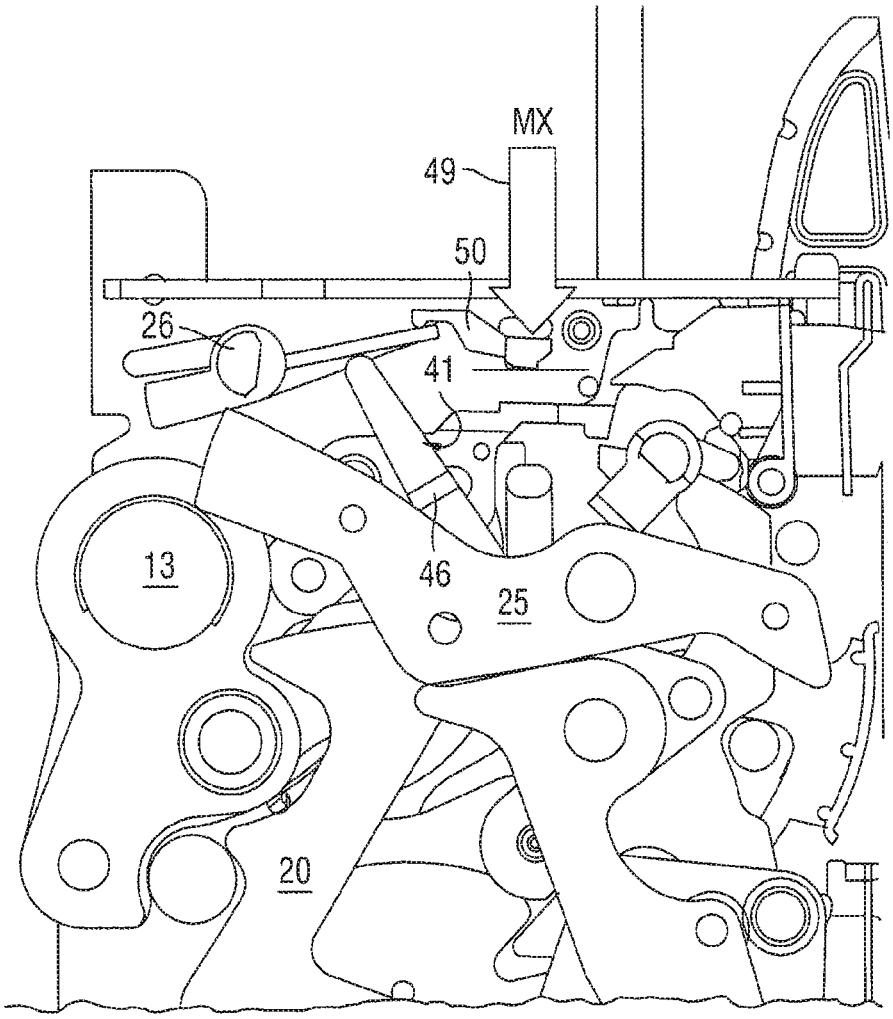
FIG. 8 represents a partial view of the kinematics between the rod of the release, the indicator lever, and the opening latch and ratchet assembly.
Figure 9:
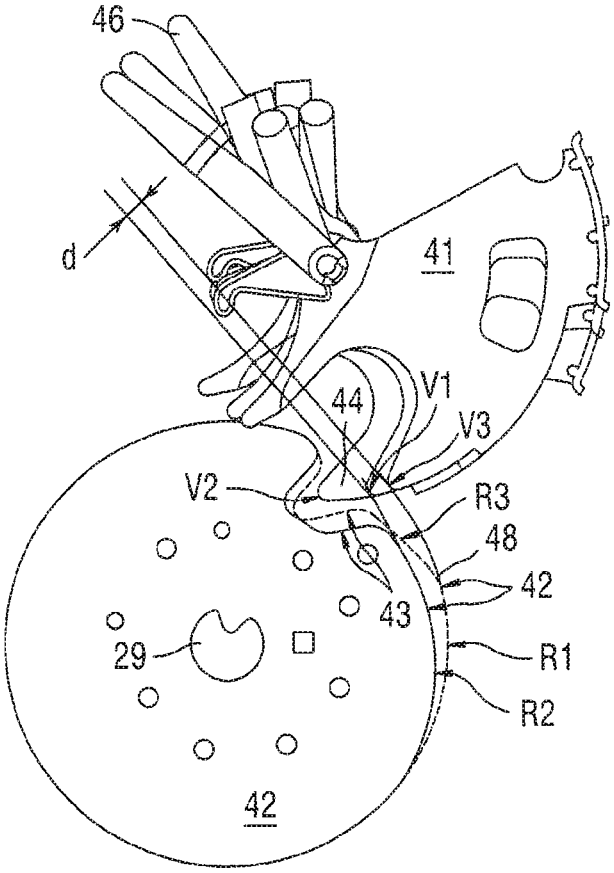
FIG. 9 shows the profile of the indicating cam according to the invention (in unbroken lines) and to the prior art (in broken lines)
Figure 9A:
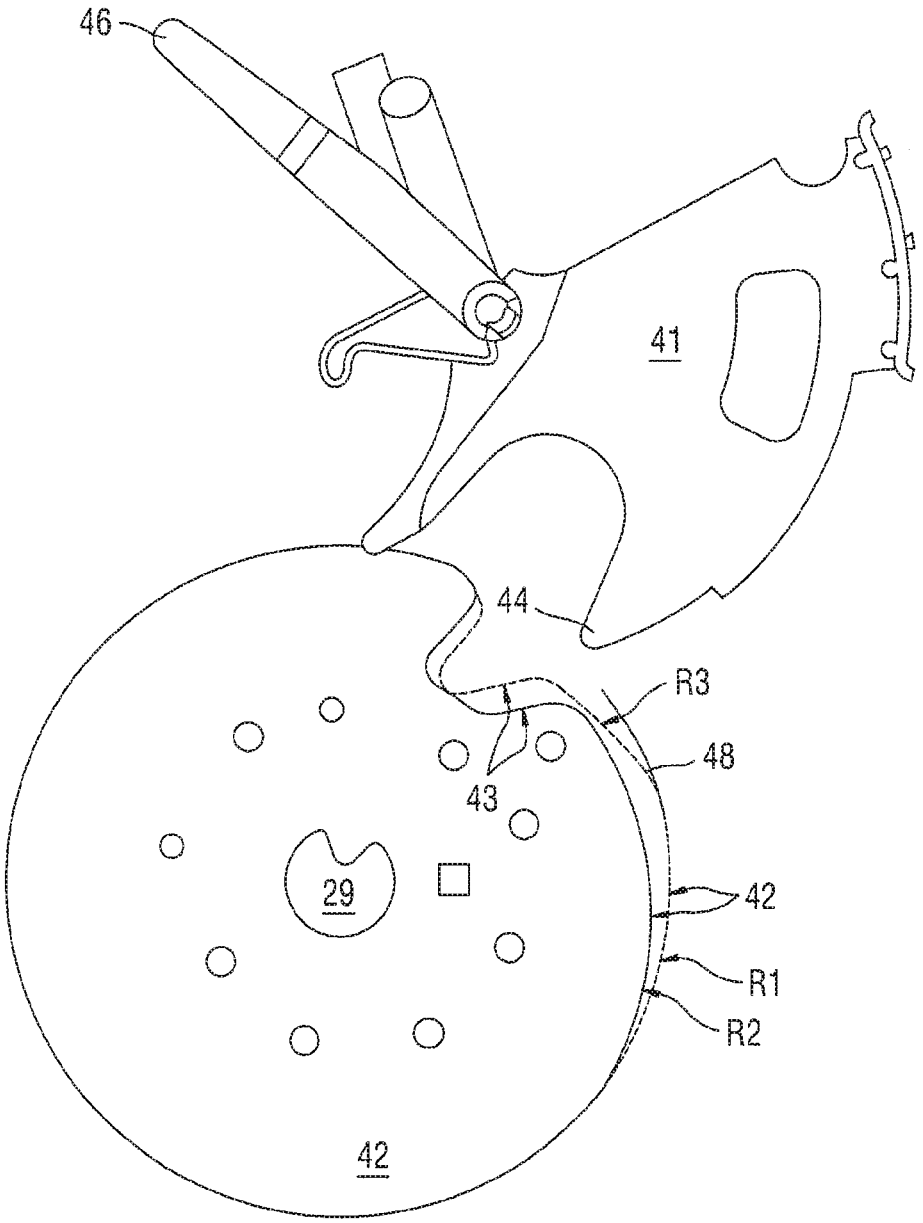
FIG. 9A shows that indicator lever 41 is in a first position of progressive movement of indicator lever 41 in the course of the loading phase.
Figure 9B:
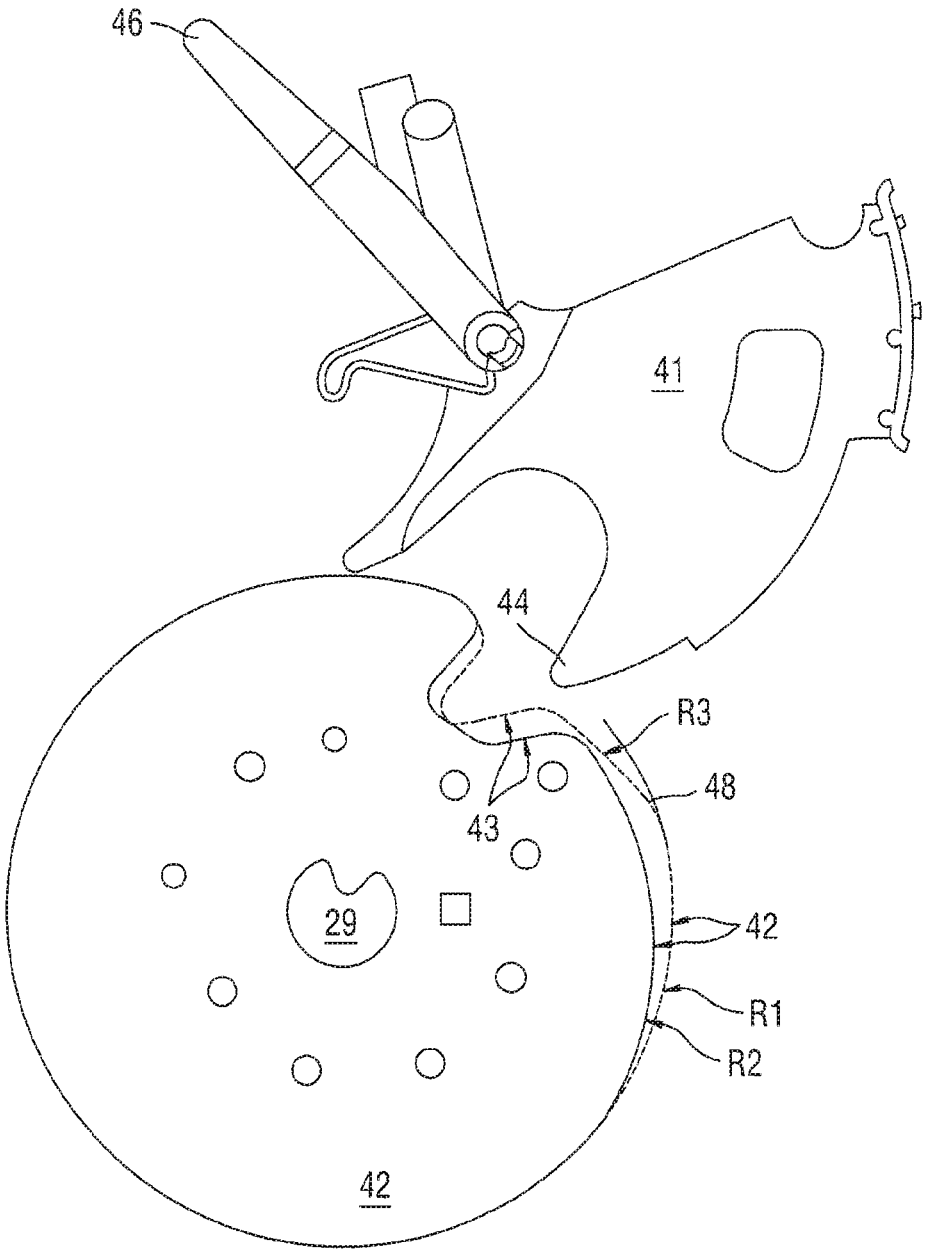
FIG. 9B shows that indicator lever 41 is in a second position of progressive movement of indicator lever 41 in the course of the loading phase.
Figure 9C:
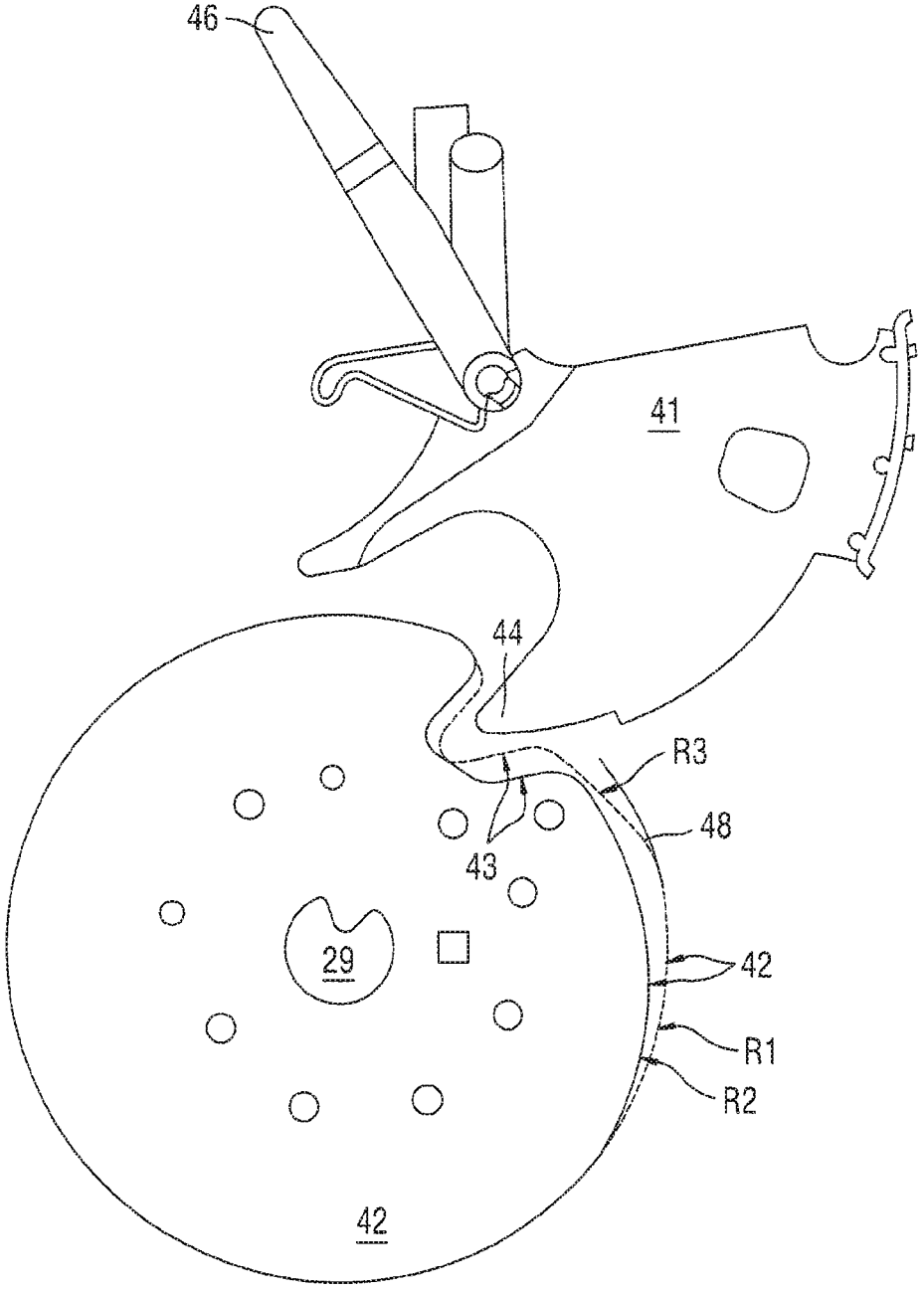
FIG. 9C shows that indicator lever 41 is in a third position of progressive movement of indicator lever 41 in the course of the loading phase.

In FIGS. 7 and 9, indicating cam 42 is represented in broken lines for a standard embodiment of the prior art and in unbroken lines for the version according to the present invention. In FIG. 9, indicator lever 41 is illustrated in several positions in the course of the loading phase. The several positions in FIG. 9 corresponding to progressive movement of indicator lever 41 are separately illustrated in FIGS. 9A, 9B and 9C respectively for each position thereof.

According to the prior art, indicating cam 42 (in broken lines) is provided with a first curved loading ramp R1 up to boss 48, and with a second ramp R2 with a reverse slope between boss 48 and receiving notch 43 of indicator lever 41 at the end of loading travel. During the reloading phase, the over-speed due to the advance of the rocking dead point of loading cam 28 causes an unsticking effect of indicator lever 41 when passing on boss 48. Indicator lever 41, which supports the second indicator 39 is symbolized by a V in FIG. 9. This unsticking was detected by means of an ultrafast vision system, with a maximum falling height before dropping into notch 43 of indicating cam 42. V1 represents the position of the indicator before rocking and V2 its position when entering notch 43 indicating the loaded state of energy storage device 21. The mechanical impact arising from this too great falling height is thus transmitted to auxiliary release MX by third arm 46 of indicator lever 41, which acts on opening latch 26 and an auxiliary lever 50 causing dropping of rod 49 of the auxiliary release MX. The mechanical latching function by auxiliary release MX is no longer guaranteed in complete safety.

Indicating cam 42 according to the invention (in unbroken lines in FIG. 9 and FIG. 10) presents a single ramp R3 enabling progressive movement of indicator lever 41 into position up to notch 43. V3 indicates the position of the indicator before rocking, with elimination of inverted second ramp R2 which prevents boss 48 from lifting off. The dropping height of indicator lever 41 is thus reduced by a distance d when the latter is inserted in notch 43. The withstand of auxiliary release MX is not affected, and its rod remains in the salient position so as to guarantee the mechanical latching function preventing any reclosing of the contacts without the fault having been acknowledged.

Figure 10:
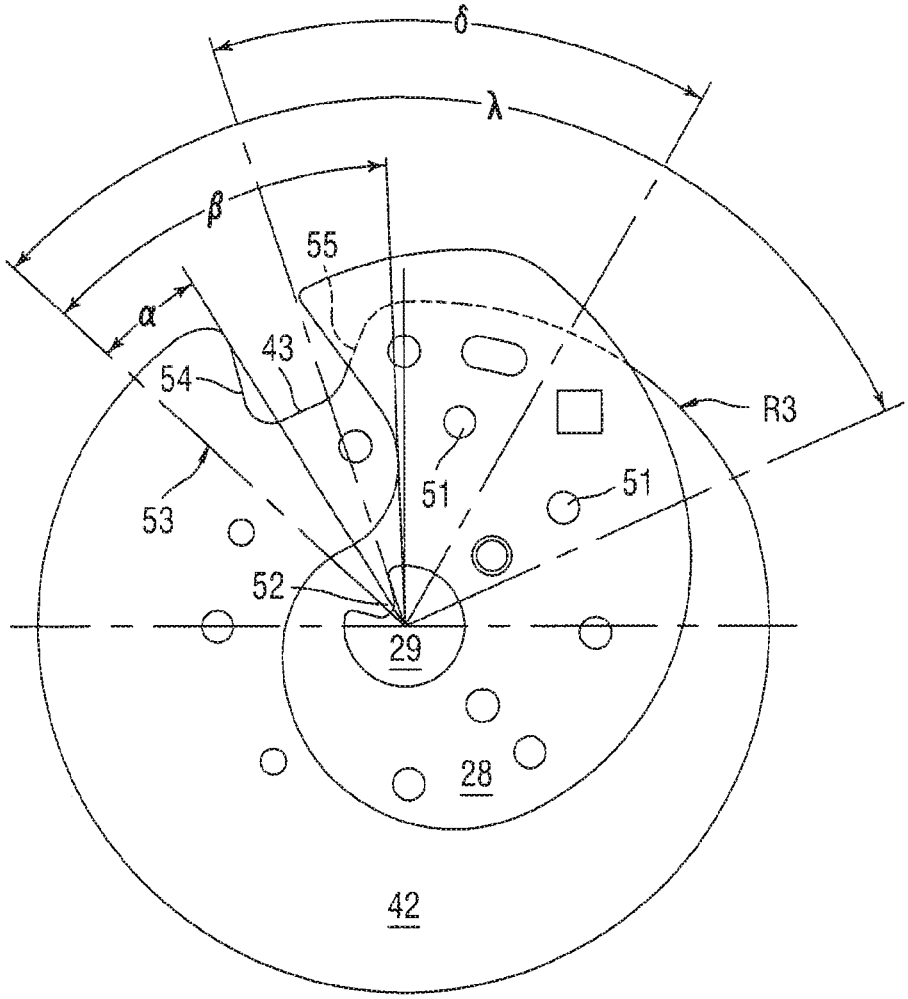
FIG. 10 represents the loading cam and indicating cam assembly mounted on the loading shaft.

In FIG. 10, loading cam 28 and indicating cam 42 are mechanically secured to one another by spacers 51. The assembly formed by the two cams 28, 42 is engaged axially and fixed onto loading shaft 29 which is advantageously grooved in the axial direction. Each cam 28, 42 comprises for this purpose a central opening of circular shape provided with a radial index 52. The openings of the two cams 28, 42 are aligned actually with their indexes 52, which are positioned in the groove of loading shaft 29. The radial direction passing through the aligned indexes 52 of the two cams 28, 42 determines a radial reference plane 53. Notch 43 of indicating cam 42 is U-shaped, delineated by a straight first flank 54, an inclined second flank 55, and a closed bottom joining the two flanks 54, 55.

The angular positioning of notch 43 and of ramp R3 of indicating cam 42 with respect to radial reference plane 53 is the following:

straight first flank 54 is offset from reference plane 53 by an angle $\propto$ comprised between 10° and 20°;

the top end of second flank 55 joining the terminal part of progressive ramp R3 is separated from reference plane 53 by an angle $\beta$ comprised between 20° and 40°;

the beginning of progressive ramp R3 is separated from reference plane 53 by an angle $\lambda$ comprised between 90° and 120°.

OCO operating mechanism 14 of the circuit breaker enables the latching function to be performed in complete safety by the auxiliary release MX having received an opening order when a fault has occurred.

The invention claimed is:

1. A multipole electric circuit breaker having a pair of separable contacts per pole and an operating mechanism, comprising:

a toggle device associated with a switching bar and with a trip latch;

an opening spring automatically loaded when a closing operation of the toggle device takes place;

an energy storage device including a closing spring operated by a loading device including a loading cam keyed onto a loading shaft, and a drive part acting as transmission between the energy storage device and the toggle device to perform driving of the switching bar and of movable contacts to a closed position when relaxation of the closing spring takes place;

a closing ratchet and latch configured to lock the energy storage device in a loaded state;

an opening ratchet and latch configured to collaborate with the trip latch and with an auxiliary release; and an indicating device including an indicator lever with indicator collaborating with an indicating cam to indicate loaded, unloaded, and ready-to-close states of the mechanism, the indicating cam being fitted on the loading shaft close to the loading cam, and including a notch for receiving the indicator lever when the mechanism is in the loaded state, wherein the indicating cam includes a single ramp for progressively moving the indicator lever into position up to the notch to guarantee latching of the opening latch maintained in the tripped position by the auxiliary release, the notch of the indicating cam is U-shaped, delineated by a first flank, a second flank and a flat between a bottom end of the first flank and a bottom end of the second flank, the first flank being offset from the reference plane by an angle between 10° and 20°, and a top end of the second flank joining an ending of a progressive ramp being separated from the reference plane by an angle between 20° and 40°, and a radius of the indicating cam at a top end of the first flank is longer than at the top end of the second flank.

2. The electric circuit breaker according to claim 1, wherein the loading cam presents a rocking dead point offset from an end of the loading cam by an angle between 30° and 45°.

3. The electric circuit breaker according to claim 1, wherein the loading shaft is actuated by a manual resetting handle and a geared motor keyed onto the loading shaft electrically performs a resetting when the manual resetting handle is triggered.

4. The electric circuit breaker according to claim 1, wherein the loading cam and the indicating cam are mechanically secured to one another by spacers and are mounted axially on the loading shaft, which is grooved in the axial direction, and each cam includes a central opening of circular shape including a radial index to constitute a radial reference plane passing through the aligned indexes.

5. The electric circuit breaker according to claim 4, wherein a beginning of the progressive ramp is separated from the reference plane by an angle between 90° and 120°.

* * * * *